US005932835A

United States Patent [19]

Woodall et al.

[11] Patent Number: 5,932,835

[45] Date of Patent: Aug. 3, 1999

[54] LINE CHARGE INSENSITIVE MUNITION WARHEAD

[75] Inventors: Robert Woodall, Lynn Haven; Felipe Garcia, Panama City; Gilberto Irizarry, Panama City Beach, all of Fla.

[73] Assignee: The United States of America as represented by the Secretary of the Navy, Washington, D.C.

[21] Appl. No.: 08/944,049

[22] Filed: Sep. 12, 1997

[51] Int. Cl.[6] ..... B63G 7/02; B21D 39/02

[52] U.S. Cl. ..... 102/403; 102/473; 149/19.9; 149/92; 29/463; 29/525.05; 89/1.13

[58] Field of Search ..... 102/403, 482, 102/487, 302, 473; 89/1.13; 29/463, 525.01, 525.05; 149/19.4, 19.9, 92

[56] References Cited

U.S. PATENT DOCUMENTS

| | | | |
|---|---|---|---|
| 426,559 | 4/1890 | Dithridge | 29/525.05 |
| 1,886,421 | 11/1932 | Perkins | 29/525.05 |
| 2,101,071 | 12/1937 | King | 102/487 |
| 3,049,999 | 8/1962 | Sunden | 102/487 |
| 3,625,152 | 12/1971 | Schneider, Jr. | 102/473 |
| 3,724,319 | 4/1973 | Zabelka et al. | 102/403 |
| 4,145,972 | 3/1979 | Menz et al. | 102/270 |
| 4,400,860 | 8/1983 | Nonnenmann et al. | 29/463 |
| 5,445,690 | 8/1995 | Wulfman et al. | 149/109.6 |
| 5,524,524 | 6/1996 | Richards et al. | 89/1.13 |
| 5,565,150 | 10/1996 | Dillehay et al. | 264/3.3 |
| 5,675,104 | 10/1997 | Schorr et al. | 89/1.13 |
| 5,750,921 | 5/1998 | Chan et al. | 149/19.92 |

*Primary Examiner*—Charles T. Jordan
*Assistant Examiner*—Christopher K. Montgomery
*Attorney, Agent, or Firm*—Harvey A. Gilbert; Donald G. Peck

[57] ABSTRACT

A warhead has a pair of shells, each having an annular rim at one end and an opening at the other end. The rims abut one another and are fastened together to define a chamber filled with explosive having a bore aligned with the openings. The explosive has sensitivity to detonation that requires axial detonation in the bore by a detonating cord to initiate explosion thereby preventing detonation by lesser stimuli. A tube extends through the openings and bore and is sized to receive the detonating cord. Opposite ends of the tube are crimped to hold the shells together. A line charge provided with a plurality of such warheads has significant pressure, shock, fragmentation energy, wire cutting ability and mine neutralization capacity as compared to contemporary devices. These improved capabilities are directly attributed to the explosive type and density of this design. In addition, the materials selected for fabrication have the appropriate toughness hardness, and thickness to generate these capabilities upon detonation of the explosive. When tested against anti-personnel mines and wire obstacles, this lightweight design was efficient and effective. Furthermore, as an added feature, this warhead was found to comply with all insensitive munitions requirements.

18 Claims, 2 Drawing Sheets

LINE CHARGE INSENSITIVE MUNITION WARHEAD

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to deployable munitions. In particular, this invention relates to warheads in line charges that are reliably deployed for clearing mines and obstacles that effectively detonate and do not create undue hazards during handling and deployment.

Anti-personnel obstacles and mines have been cleared from narrow passageways, or lanes, using a number of explosive devices, such as the Bangalore Torpedo. The Bangalore Torpedo is not without its disadvantages, however. Generally speaking, although it is said to be portable, it still has considerable weight and bulk. But, of even greater significance, it exposes several members of the firing team to enemy fire for extended periods as it is being emplaced. Other demolition systems are available, but they too, for one reason or another, are inadequate or unacceptable for man portable breaching operations. Hence, lightweight and readily deployable line charges capable of clearing all types of antipersonnel mines and wire obstacles are still in demand.

Furthermore, the series of warheads used in the required line charge should meet the Insensitive Munitions Requirements as set out in NAVSEA INST 8010.5A "Technical Requirements for Insensitive Munitions" (IM). The requirements with references to other documented materials are set forth in detail in this instruction. Briefly, insensitive munitions are those which reliably fulfill their performance, readiness, and operational requirements on demand, but are designed to minimize the violence of reaction and subsequent collateral damage when subjected to unplanned stimuli, such as heat, shock, fragment or bullet impact, electromagnetic pulse (EMP), or other unplanned stimuli. Insensitive munitions must meet tests for slow cook-off, fast cook-off, electromagnetic pulse (EMP), multiple bullet impact, and multiple fragmentation impact that produce no reaction more severe than burning and must have no sympathetic detonation within predetermined ranges of temperature and humidity, temperature cycling, drop, and vibration in a stowage configuration.

Warheads in all previous line charge systems failed to meet IM requirements, and consequently, this failure elevated the risk of an explosive mishap to undesirable and unacceptable levels.

Thus, in accordance with this inventive concept, a need has been recognized in the state of the art for reliably deployed warheads in line charges that are capable of clearing mines and obstacles and that meets insensitive munitions requirements to further reduce risks of explosive mishaps.

SUMMARY OF THE INVENTION

The present invention is directed to providing an improved warhead. A pair of shells each has an annular rim at one end and an opening at the other end. The rims abut one another to define a chamber in the shells and to axially align the openings. An annular strip is crimped on the rims to hold the shells together. Explosive in the chamber is provided with a bore that is aligned with the openings. The explosive has sensitivity to detonation that requires axial detonation in the bore by an initiating device such as such as detonation cord, electric detonators with cables, and non-electric trains to initiate explosion thereby preventing detonation from lesser stimuli or from the correct stimuli, but not applied axially through the bore. A tube extends through the openings and bore, has portions at opposite ends that engage the shells to hold them together, and is sized to permit longitudinal displacement of the initiating device.

An object of the invention is to provide warheads for a line charge for clearing mines and obstacles.

Another object of the invention is to provide warheads that are not secured to a detonating cord but allow for effective detonation transfer from the detonating cord.

Another object of the invention is to provide warheads that meet insensitive munitions requirements.

Another object of the invention is to provide a warhead explosive having sensitivity to detonation that requires axial detonation in its internal bore by a device to initiate explosion thereby preventing detonation from lesser stimuli or from the correct stimuli, but not applied axially through the bore.

Another object of the invention is to provide warheads that allow for direct loading of explosives into the chamber inside a pair of shells and provide for easy assembly.

Another object of the invention is to provide warheads for a lightweight line charge capable of clearing antipersonnel mines and wire obstacles while meeting insensitive munitions requirements.

Another object of the invention is to provide warheads for line charges that are loaded with explosives and crimped together in a single final assembly process.

Another object of the invention is to provide warheads filled with explosive main charges and boosters that are relatively insensitive to detonation.

Another object of the invention is to provide protuberances on the shells of each warhead that allow for alignment and securing of the mechanisms used to hold each warhead to a line charge.

Another object of the invention is to provide a center tube in each warhead in a line charge that is sized to permit longitudinal displacement of a detonating cord that runs through it to adjacent warheads.

Another object of the invention is to provide a center tube in each warhead in a line charge that ensures adequate explosive propagation through it from the initiated detonating cord into the booster and main charge of each warhead.

Another object of the invention is to provide a center tube in a warhead that is roll-crimped at its ends to hold the shells together and to provide pressure relief before extreme heating conditions cause catastrophic warhead failure.

Another object of the invention is to provide a center tube in a warhead that is roll-crimped to reduce abrasion of the detonating cord during handling.

Another object of the invention is to provide a warhead provided with a clamp ring crimped to securely hold the shells together to provide for pressure venting prior to catastrophic warhead failure caused by extreme heating conditions.

Another object of the invention is to provide a warhead having significant pressure, shock, and fragmentation energy to effectively and efficiently cut wire and neutralize mines due to the type and density of the explosive, and the toughness, hardness, and thickness of the material of the shells.

Another object of the invention is to provide warheads capable of holding securely to a line charge for demolition.

Another object of the invention is to provide effective warheads for line charges at reduced weight.

These and other objects of the invention will become more readily apparent from the ensuing specification when taken in conjunction with the appended claims.

DESCRIPTION OF THE PREFERRED EMBODIMENTS

Figure 1:
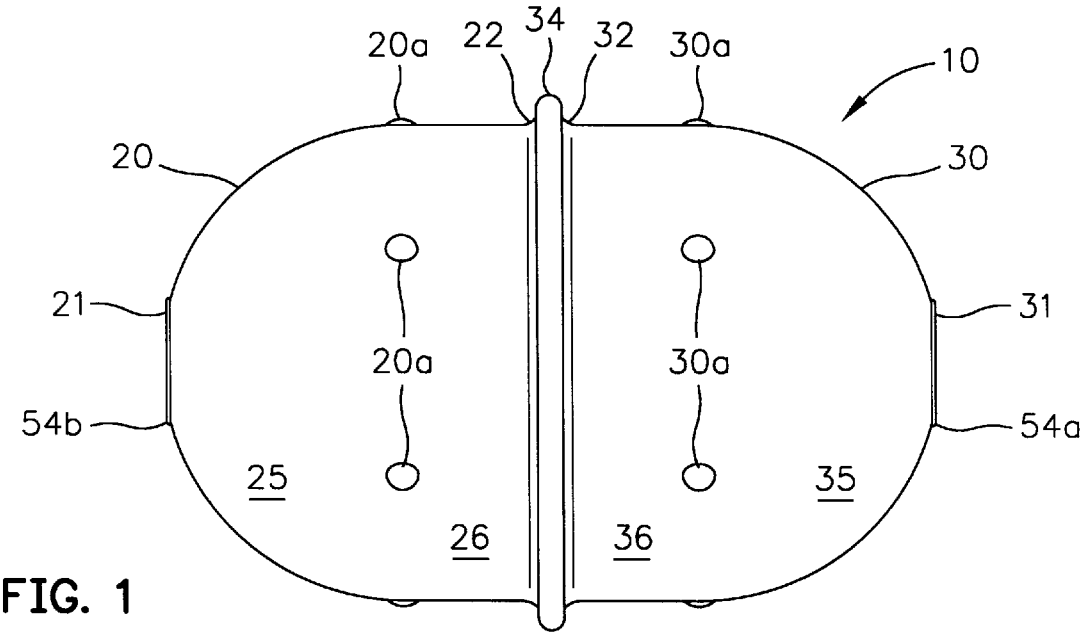
FIG. 1 is a side view of the warhead of the invention for deployment in a line charge to breach obstacles and mines.
Figure 2:
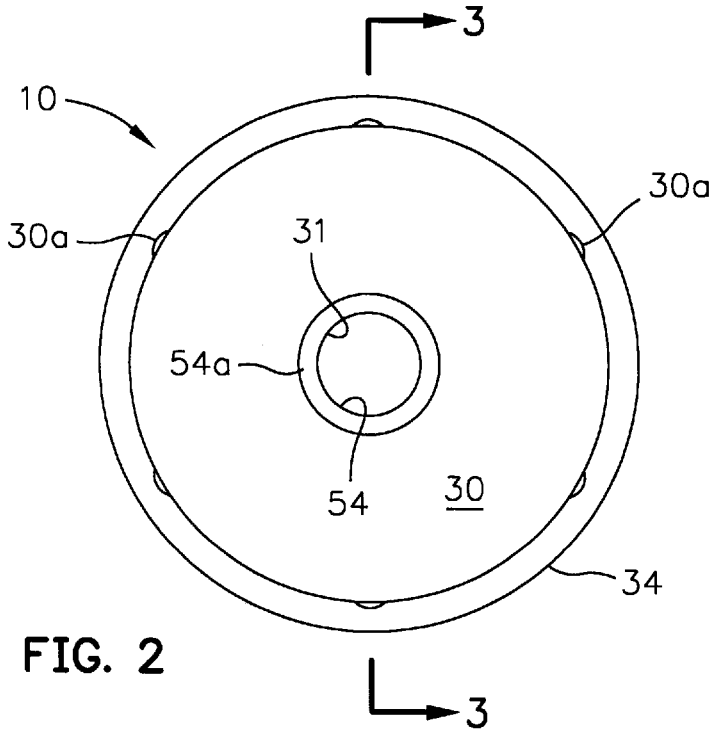
FIG. 2 is an end view of the warhead of this invention.
Figure 3:
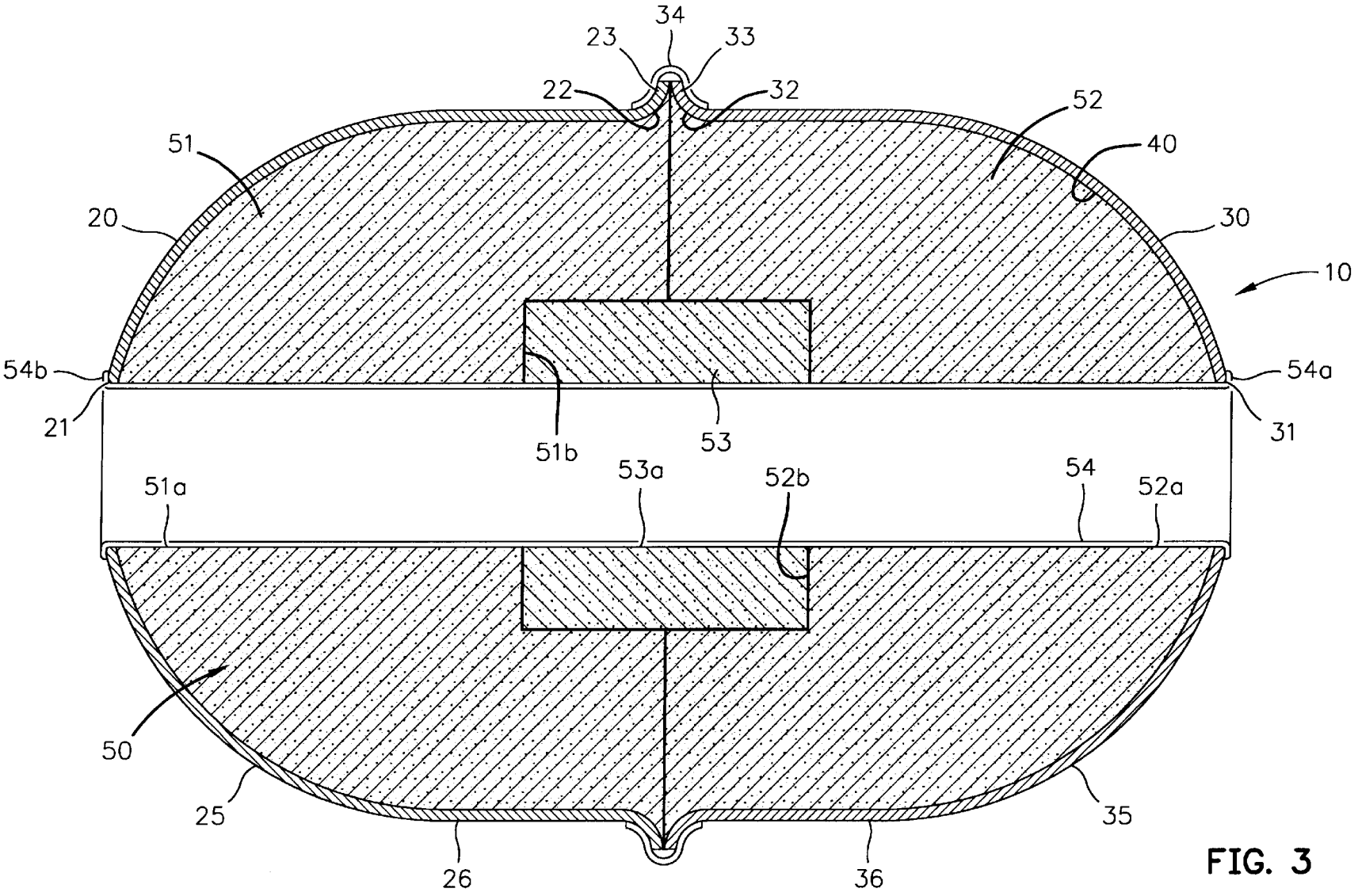
FIG. 3 is a cross-sectional side view of the warhead of this invention taken generally along lines 3—3 in FIG. 2.

Referring to FIGS. 1, 2, and 3 of the drawings, warhead 10 of this invention has evolved to meet the requirements of a demanding mission. This mission calls for using a number of such warheads arranged in a structure containing a series or line of such explosive charges. Accordingly, this structure is commonly referred to as a line charge and it is used to clear a lane through an area laden with wire and/or mine obstacles that block or interfere with free passage through it.

For successful operation, the line charge is placed to lie across the area and is detonated. One method of emplacing the line charge relies on a rocket motor attached to one end of it while its other end is tethered or attached to a drogue chute at the near side of the area. The rocket motor is aimed in a path that extends across the area and is fired. The rocket motor pulls the line charge to extend across the area and it is detonated. The obstacles, such as wire entanglements and/or mines, for example, are broken-up, blown out of the way, and/or detonated either by actuation of the firing mechanisms or sympathetic detonation of the explosive loads to define a cleared lane across the area.

The clearing capability of the line charge is directly dependent on the reliability and effectiveness of its warheads 10. Not only the amount, size, and spacing of warheads 10 are important, but the design of warhead 10 has been found to be critical for effective clearing of obstacles.

Therefore, in accordance with this invention, FIGS. 1 and 2 show side and end views of warhead 10 that is specifically designed for inclusion in line charges that effectively clear passageways in mine fields and obstacles. Due to the uncomplicated and straightforward design of warhead 10, it may be readily assembled from constituent parts, to be described below, by personnel at depots or in the field according to the needs of a particular breaching operation.

Warhead 10 is made from a pair of shells 20 and 30. Each of shells 20 or 30 is respectively provided with a hole, or opening 21 or 31 at one end and a rim 22 or 32 with outwardly extending lip portions 23 or 33 at its opposite end. When the shells are positioned so that rims 22 and 32 and lips 23 and 33 are adjacent and abut one another, openings 21 and 31 are axially aligned in the longitudinal axis of warhead 10. A crimpable annular strip, or clamp ring 34 encircles shells 20 and 30 about lips 23 and 33. Clamp ring 34 is fabricated from steel sheet AISI 1010 cadmium plated and has an outer, uncrimped diameter of about 2.257 inches and width of about 0.215 of an inch. When clamp ring 34 is inwardly roll-crimped about lips 23 and 33, shells 20 and 30 are held together to define explosives chamber 40.

FIG. 3 shows that each shell 20 or 30 has substantially hemispherically-shaped portions 25 or 35 and coextensive cylindrical portions 26 or 36, respectively. The sizes of portions 25 and 35 and 26 and 36 may be extended or otherwise tailored to provide the right sized explosives chamber 40 to hold enough explosives for the job at hand.

Shells 20 and 30 are formed from sheets of 0.040 inch Steel Alloy AISI 4140 having a Rockwell Hardness of C50 minimum. Each of hemispherically-shaped portions 25 and 35 has an inner diameter of about 1.913 inches and each of cylindrical portions 26 and 36 has lengths of 0.375 of an inch. This fabrication material, dimensioned as described, provided sufficient blast and fragmentation to neutralize mines and cut wire obstacles of the type likely to be encountered by infantry. For other breaching applications, other suitable case, or shell, materials and sizes could be selected by one skilled in the art.

A number of dimples, or protuberances 20*a* and 30*a* are formed and equally spaced radially about the circumference of the shells to function as attachment points to secure the individual warheads to other structure of a line charge. Although any number of such securing parts could be formed, six such protuberances have been used with satisfactory results.

Explosives chamber 40 holds main charge 50 that is made up of two parts of explosive 51 and 52 that are pressed into shells 20 and 30, respectively. Each of explosive parts 51 and 52 has a hemispherical portion and a cylindrical portion each provided with bores 51*a* and 52*a* that are axially aligned with openings 21 and 31, respectively. The explosive selected for explosive parts 51 and 52 is fabricated from explosive, plastic-bonded, pressed PBXN-9 including the explosive HMX, and the plastic binders polyacrilic elastomer marketed under trademark HYTEMP 4454, and di-(2-ethylhexyl)adipate technical, that is pressed-fit to a density of 1.68 to 1.73 grams/cubic centimeter in the appropriate shape which is fitted into shells 20 and 30. As an alternate assembly technique, the PBXN-9 explosive selected for explosive parts 51 and 52 is the right amount of PBXN-9 explosive that is pressed-fit in shells 20 and 30 to fill them at a density of 1.68 to 1.73 grams/cubic centimeter. Each half 51 or 52 has a hemispherical portion of about 1.913 inches in diameter with axial bore 51*a* or 52*a* of about 0.388 of an inch, and a coextensive cylindrical portion about 1.375 inches in length with a recess 51*b* or 52*b* measuring 0.375 of an inch deep by 0.875 of an inch diameter.

A ring-shaped booster pellet 53 is preshaped or cast-on-site and is pressed into appropriate recesses 51*b* and 52*b* in explosive parts 51 and 52. Booster pellet 53 is fabricated from explosive, plastic-bonded molding powder PBXN-5 including copolymer(vinylidene fluoride & hexafluoropropylene) and the explosive HMX that is pressed at 32,000 pounds per square inch. Booster pellet 53 is about 0.748 of an inch long and has an inner diameter about 0.388 of an inch and an outer diameter of about 0.866 Of an inch. The inner diameter, or bore 53*a*, of booster pellet 53 is aligned with bores 51*a* and 52*a*.

Center tube 54 extends through bores 51*a* and 52*a* of explosive parts 51 and 52, bore 53*a* of booster pellet 53, and openings 21 and 31. Tube 54 is made of about 0.015 inch thick 6061-T6 Aluminum. Tube 54 is about 3.310 inches long and has an inner diameter of about 0.345 of an inch. End portions 54*a* and 54*b* of tube 54 extending through openings 21 and 31 are roll-crimped in a smooth radius and further secure shells 20 and 30 together.

Several such warheads 10 as described above may be placed in a line charge, and a common detonating cord can be inserted through tubes 54 of each of them to create a formidable weapon. Upon detonation of the detonating cord, booster pellet 53 of each warhead 10 initiates to set off the main charge 50 of PBXN-9 explosive. The explosives in warhead 10 have sensitivities to detonation that requires axial detonation in the axial bores by the detonating cord to initiate explosion. This feature also prevents detonation from other influences including lesser stimuli, such as small arms ammunition, slow or fast cook-off conditions, for example. Controlled detonation of the warhead by the detonating cord results in fragmentation, shock wave, and over pressure of sufficient energy to neutralize mines and anti-personnel obstacles.

Warhead 10 fabricated according to this invention inherently possesses advantages and capabilities heretofore not realized in the art. Warhead 10 is the only warhead that meets all Insensitive Munitions Requirements, see the above referenced NAVSEAINST document. The design of warhead 10 makes it lightweight, yet remain effective for breaching operations.

Warhead 10 is capable of being loaded with explosives and crimped together on a single final assembly process; it is easy to assemble and the design lends itself to automated explosive loading. The explosives for the warhead and the booster pellet are selected to be insensitive to detonation. In that regard and as mentioned above, the explosives of both the main charge and booster have sensitivities to detonation that requires detonation of the detonating cord, (or other selected device for initiating detonation, such as electric detonators with cables and non-electric detonating trains in the axial bore provided through the main charge and the booster to initiate explosion. This feature helps prevent the untimely detonation from lesser stimuli or from the correct stimuli, but not applied axially through the bore. Thus, the explosives named above were identified for the purposes of demonstrating this inventive concept and were not intended to be limiting. Having the teachings of this invention in mind, one skilled in the art to which this invention pertains can select a number of suitable explosives that meet this requirement as well as other performance or cost requirements. Furthermore, a number of other suitable materials for fabrication of the shells and tubes can also be selected and still be within the scope of this invention.

Dimples 20*a* and 30*a* on shells 20 and 30 allow for alignment and securing of the mechanisms used to hold any number of warheads 10 to a line charge. Thus, more or less warheads can be included and their relative separations from each other can be tailored to different breaching tasks.

Each center tube 54 is sized to permit a detonating cord to pass through each warhead 10 and onto the next. The material of center tube 54 is selected to ensure that adequate explosive transfer can be propagated from initiated detonating cord, through the tube into booster pellet 53 and subsequently onto main charge 50 of warhead 10.

Roll-crimped end portions 54*a* and 54*b* on center tube 54 securely hold shells 20 and 30 together. At the same time, roll-crimped end portions 54*a* and 54*b* provide a pressure-relief point to avoid catastrophic failure of the shells. This pressure-relief point may be needed to vent internal pressures created in the shells by possible expansion of main charge 50 during conditions of extreme heating or other stimuli, like bullet impact. The rolled crimp of end portions 54*a* and 54*b* also ensures against abrasion of the jacket of the detonating cord during the handling of a plurality of warheads arranged in a line charge. Additionally, clamp ring 34 also holds shells 20 and 30 together. At the same time, clamp ring 34 also provides a pressure-relief point to avoid catastrophic failure of the shells. This pressure-relief point may also help to vent internal pressures that might be created in the shells by possible expansion of main charge 50 during conditions of extreme heating or other stimuli, like bullet impact.

The structure of shells 20 and 30 provides for direct and economical loading of main charge 50 and ring-shaped booster pellet 53 into warhead 10. A line charge provided with a plurality of warheads 10 has markedly improved and significant pressure, shock, fragmentation energy, wire cutting ability and mine neutralization capacity as compared to contemporary devices. These improved capabilities are directly attributed to the explosive type and density of main charge 50 and booster 53. In addition, the material of shells 20 and 30 has the appropriate, toughness, hardness, and thickness to generate these capabilities upon detonation of the explosives. When tested against anti-personnel mines and wire obstacles, the design set forth above was effective and efficient to meet the needed requirements. The warheads of this invention are lightweight. Furthermore, this invention complied with all IM requirements.

The arrangements of constituent parts described hereinabove and the exemplary embodiments disclosed herein are not to be construed as limiting, but rather are intended for the purpose of demonstrating this inventive concept. Therefore, it is to be understood that, having the teachings of this invention in mind, one skilled in the art to which this invention pertains can select other materials and dimensions of materials, etc. and still be within the scope of this invention. Similarly, the capabilities of the invention that were disclosed herein were selected for demonstration of some salient features of this invention. They are not to be construed as limiting the scope of this invention.

It should be readily understood that many modifications and variations of the present invention are possible within the purview of the claimed invention. It is therefore to be understood that within the scope of the appended claims the invention may be practiced otherwise than as specifically described.

I claim:

1. A warhead comprising:

a pair of shells, each having an annular rim at one end and an opening at the other end, said rims of said shells abutting one another to define a chamber and to axially align said openings and each rim having a lip radially extending therefrom:

a fastener adjacent said rims to hold said shells together;

explosive in said chamber, said explosive having a bore aligned with said openings and having sensitivity to detonation that requires axial detonation in said bore by an initiating device to initiate explosion thereby preventing detonation from lesser stimuli; and a tube extending through said openings and bore having portions at opposite ends engaging said shells to hold them together along said rims, said tube being sized to permit longitudinal displacement of said initiating device for initiating detonation of said explosive therein, said fastener being an annular strip inwardly roll-crimped to hold said radially extending lips together, and said end portions of said tube being outwardly roll-crimped to engage said shells.

2. An apparatus according to claim 1 in which said initiating device is selected from the group of such devices consisting of detonation cord, electric detonators with cables, and non-electric detonating trains.

3. An apparatus according to claim 2 in which said shells are hemispherically-shaped.

4. An apparatus according to claim 3 in which said hemispherically-shaped shells each have coextensive cylindrically-shaped portions.

5. An apparatus according to claim 4 in which said explosive includes a main charge and a booster charge both having sensitivities to detonation that require axial detonation in said bore to initiate explosion thereby resisting detonation by lesser stimuli, and said tube transfers explosive force from said initiating device to said booster and main charge to initiate detonation thereof.

6. An apparatus according to claim 5 in which said main charge is fabricated from explosive, plastic-bonded, pressed PBXN-9 including explosive HMX, and plastic binders polyacrilic elastomer, and di-(2-ethylhexyl)adipate technical, and said booster charge is fabricated from explosive, plastic-bonded molding powder PBXN-5 including copolymer(vinylidene fluoride & hexafluoropropylene) and explosive HMX, and said tube transfers explosive force from said initiating device to said booster and main charge to initiate detonation thereof.

7. An apparatus according to claim 6 in which said shells are fabricated from steel alloy AISI 4140 having a Rockwell Hardness of at least C50.

8. An apparatus according to claim 7 in which said shells are provided with a plurality of protuberances for engaging means for remotely deploying said apparatus.

9. An apparatus according to claim 8 in which said shells and tube are made from frangible materials to vent pressure.

10. A warhead comprising:

means for enclosing a chamber, said enclosing means including a pair of shells each having an annular means at one end and an opening at the other end, said annular means of said shells abutting one another to define said chamber in said shells and to axially alien said openings and each annular means having a lip radially extending therefrom;

means on said shells for fastening said annular means together to hold said shells together;

means disposed in said chamber for exploding having a bore aligned with said openings, said exploding means having sensitivity to detonation that requires axial detonation in said bore by an initiating device to initiate explosion thereby preventing detonation from lesser stimuli; and means extending through said openings and bore for providing an elongated passageway through said exploding means, said providing means having portions at opposite ends engaging said shells to hold them together along said annular means and having a tube sized to permit longitudinal displacement of said initiating device for initiating detonation of said exploding means therein, said fastening means being an annular strip inwardly roll-crimped to hold said radially extending lips together, and said end portions of said tube being outwardly roll-crimped to engage said shells.

11. An apparatus according to claim 10 in which said initiating device is selected from the group of such devices consisting of detonation cord, electric detonators with cables, and non-electric detonating trains.

12. An apparatus according to claim 11 in which said shells are hemispherically-shaped.

13. An apparatus according to claim 12 in which said hemispherically-shaped shells each have coextensive cylindrically-shaped portions.

14. An apparatus according to claim 13 in which said exploding means includes a main charge and a booster charge that both have sensitivities to detonation to require axial detonation in said bore to initiate explosion thereby resisting detonation from other influences.

15. An apparatus according to claim 14 in which said main charge is fabricated from explosive, plastic-bonded, pressed PBXN-9 including explosive HMX, polyacrilic elastomer, and di-(2-ethylhexyl)adipate technical, and said booster charge is fabricated from explosive, plastic-bonded molding powder PBXN-5 including copolymer (vinylidene fluoride & hexafluoropropylene) and explosive HMX, and said tube transfers explosive force from said initiating device to said booster and main charge to initiate detonation thereof.

16. An apparatus according to claim 15 in which said shells are fabricated from steel alloy AISI 4140 having a Rockwell Hardness of at least C50.

17. An apparatus according to claim 16 in which said shells are provided with a plurality of protuberances for engaging means for remotely deploying said apparatus.

18. An apparatus according to claim 17 in which said shells and tube are made from frangible materials to release pressure.

* * * * *